United States Patent [19]

Merrien et al.

[11] Patent Number: 4,585,050

[45] Date of Patent: Apr. 29, 1986

[54] PROCESS FOR AUTOMATIC REGULATION OF A CASTING CYCLE

[75] Inventors: Pierre L. Merrien, Billere; Pierre A. Merrien, Sceaux, both of France

[73] Assignee: Etude et Developpement en Metallurgie, E.D.E.M., S.A.R.L., Billere, France

[21] Appl. No.: 746,947

[22] Filed: Jun. 21, 1985

Related U.S. Application Data

[63] Continuation of Ser. No. 222,557, Jan. 5, 1981, abandoned.

[51] Int. Cl.[4] ..... B22D 17/32

[52] U.S. Cl. ..... 164/457; 164/119

[58] Field of Search ..... 164/113, 119, 457

[56] References Cited

U.S. PATENT DOCUMENTS

| | | | |
|---|---|---|---|
| 3,532,154 | 10/1970 | Balevski et al. | 164/119 |
| 3,844,331 | 10/1974 | Py et al. | 164/457 |
| 3,961,662 | 6/1976 | Balevski et al. | 164/457 |
| 4,008,749 | 2/1977 | Bellocci et al. | 164/66.1 |
| 4,047,558 | 9/1977 | Kotthoff et al. | 164/309 |
| 4,085,791 | 4/1978 | Kaiser | 164/113 |
| 4,213,494 | 7/1980 | Carbonnel | 164/457 |

FOREIGN PATENT DOCUMENTS

| | | | |
|---|---|---|---|
| 1257708 | 2/1961 | France . | |
| 1376884 | 9/1964 | France . | |
| 2146148 | 3/1973 | France . | |
| 2189150 | 1/1974 | France . | |
| 0768553 | 10/1980 | U.S.S.R. | 164/155 |

*Primary Examiner*—Nicholas P. Godici
*Assistant Examiner*—Richard K. Seidel
*Attorney, Agent, or Firm*—Sandler & Greenblum

[57] ABSTRACT

The invention relates to an automatic process for regulating a casting cycle which uses a machine exerting a low pressure. It comprises controlling the level of discharge pressure introduced into a furnace in order to raise metal being cast according to precise dynamic and physical conditions. By using an ultrasonic sensor, random non-predetermined phenomena accompanying the casting, such as lowering the level of metal in the crucible and leakage of discharge fluid, are taken into account in regulating the casting cycle and casting or forming metal within a mold.

11 Claims, 7 Drawing Figures

FIG. 4.
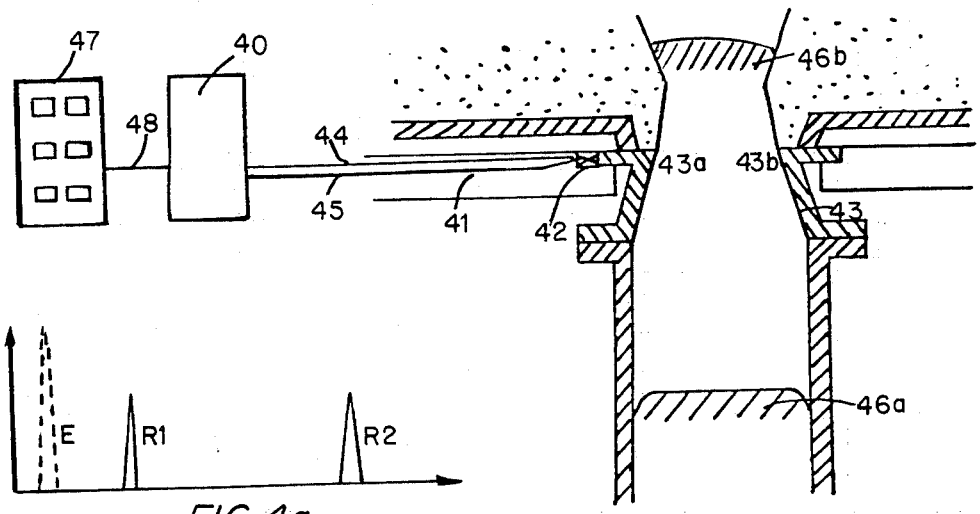
FIG. 4a.
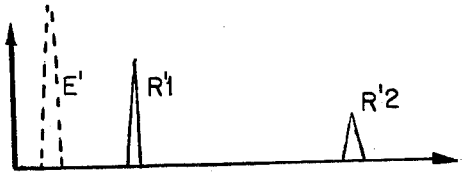
FIG. 4b.
FIG. 5.
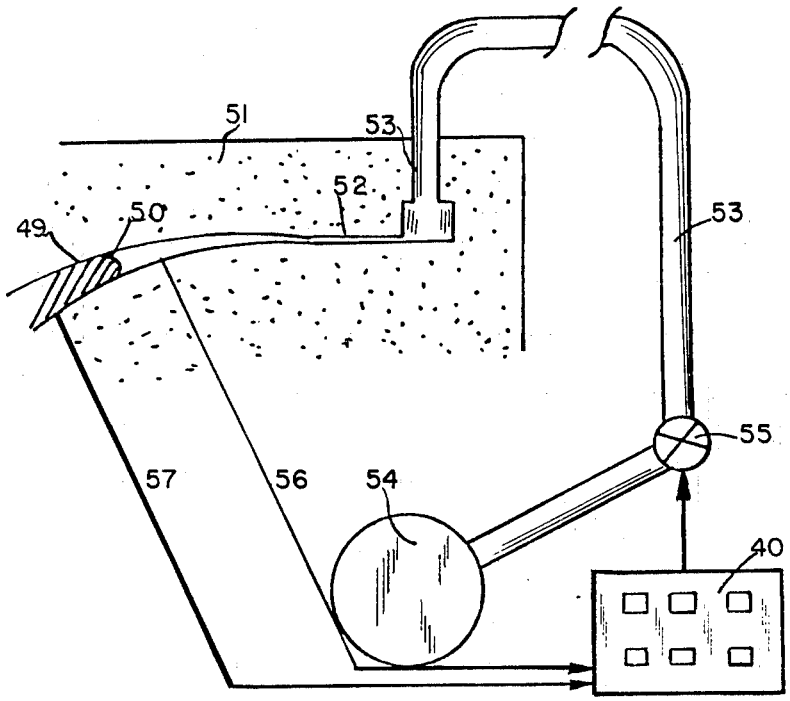

PROCESS FOR AUTOMATIC REGULATION OF A CASTING CYCLE

This application is a continuation, of application Ser. No. 222,557, filed Jan. 5, 1981, now abandoned.

BACKGROUND OF THE INVENTION

1. Field of the Invention

The present invention relates to casting procedures, particularly those used to manufacture molded articles of metal substance and preferably precision parts made from metal alloys. In particular, the present invention is directed to a method which involves the regulation of a casting cycle using low-pressure techniques.

2. Discussion of Background Information

Various processes for manufacturing molded parts, particularly cast alloy parts, under low-pressure conditions are known.

Low-pressure casting is a known foundry technique in which the bottom of a metallic or non-metallic mold is filled with a metal or a liquid alloy, placed in a hermetically sealed furnace, and solidified. The metal can rise within the mold by means of an injection tube. The filling is performed with the assistance of discharge fluid introduced into the furnace under a pressure of several decibars. After filling the mold, an excess deadhead pressure is maintained during solidification of the material. Non-solidified material is recovered from the bottom of the mold in the injection canals as soon as solidification of the part has occurred and after the discharge pressure has been stopped.

In this technique, any of the following molds can be used:

metallic molds, molds made of sand, or of various materials (graphite, zirconium, carborundum) whose grains are bonded by a binder (generally, this binder is a synthetic resin), or molds made out of ceramic or plaster.

The metallic molds are strong but expensive and are only used, as a result, for large series.

Non-metallic molds have a comparatively reduced cost. They furthermore have the advantage of adjustable permeability, and permit satisfactory filling of the depression.

This low-pressure casting technique using molds of inexpensive sand is particularly adapted to the new needs of the industry, particularly in the aeronautic field, which necessitate the production of medium series of molded alloy parts of high mechanical quality, which have delicate and defined tolerances.

The technical problems of casting affecting the quality of the products concerned are principally:

control of metal turbulence during its elevation in the mold, which turbulence relates to the speed of evolution of the metal and which determines its oxidation;

protection against ram knocks which can occur during the establishment of deadhead excess part pressures (that is to say, of compensation for their retraction) which can lead to encrustation of the metal between the grains of the mold;

non-premature occurrence of solidification;

evolution of the metal (in structure, in displacement, in cooling, etc.) conforming to the thermal need of the casting;

reproduction of operations making it possible to make the quality of parts produced uniform; and improved efficiency of the performance of the tasks.

So as to better understand the principle of operation of the process according to the invention, it should be noted that when the "casting front" of the metal is positioned in a quasi-static fashion at a level H, above the level of the metal in the crucible, the delivery pressure into the crucible is $P=H\rho g$ ($\rho$ being the volumetric mass of the metal considered and g representing the coefficient of acceleration of gravity). As soon as there is movement of the liquid, breakage forces occur between the metal and the walls.

Experience and calculations show that a differential law of variation of the discharge pressure is thus obtained by the formula:

$$(dP/dt)=K\rho g(dH/dt)=K\rho gV$$

(V is the vertical speed of elevation of the casting front and K is $\geqq 1$ and is a coefficient taking into account frictions which depend on the geometry of the mold and on V).

For low values of speed V, and thus of $dP/dt$, $K=1$.

For large values of V, K and thus V tend to an asymptotic value.

In all which follows, we place ourselves in the most common case where V is low, one thus has during the filling phase:

$$P=\rho gH \text{ and } dP/dt=\rho gV,$$

while in the excess pressure phase:

$$P=\rho gH+\alpha P,$$

$\alpha P$ being the overpressure phase undergone by the metal at the upper portion of the mold.

When the metal is in the excess pressure phase, this excess pressure depends upon the level of metal in the crucible, by means of the term H, this latter varying with the succession of castings.

Taking into account the conditions of theoretical law concerning casting, as set forth above, necessitates:

on one hand, acting on the discharge pressure of the metal, during the dynamic phases, such that the casting front progresses regularly and follows precise speed characteristics. Whatever the shape or the sharpness of the depressions to be filled, this progression must occur without suddenly slowing down, which causes too rapid solidification of the liquid mass, and sudden interruption of solidification before it is completed, and also without turbulences adapted to cause oxidations which result in weaknesses or localized discontinuities in the parts being cast, on the other hand, quickly applying to the metal, after it has filled the depression, excess pressures which are substantial enough to compensate for retraction in the course of solidification, but in varying conditions such that they do not cause penetration of metal between the grains of the mold, and finally, carrying out these actions by taking into account random disturbances, such as lowering of the metal level in the crucible and gas leaks.

The prior art attempted in vain to universally solve these problems as follows. In certain systems described to this date, the casting cycle follows phases limited by reference points situated in the depression. Flowing is caused by admission to the crucible of constant streams of air determined in advance. The speed of flow of the metal is thus only a generally unpredictable consequence of these flows, of the geometry of the parts and of the unavoidable gas leaks. Other systems impose a speed of constant variation of pressure over the entire cycle, or further carry out an adjustment at several levels of pressure so as to obtain a predetermined final pressure. These systems do not correct the pressure to take into account drops in the level of the metal. This prevents reproduction of the castings. Finally, certain systems perform a correction based upon given indications at the beginning of the sequence, particularly with an analogue computer. But his requires a preliminary adjustment and excludes the possibility of casting different parts in each cycle as has often been the case in the aeronautical field. Furthermore, the corrections performed suffer from imprecision in their evaluation and the errors committed, in general, only grow with successive castings.

SUMMARY OF THE INVENTION

The object of the present invention is to universally solve the entirety of the previously recited problems posed by low-pressure casting as follows:

it proposes a success making it possible to impose to the metal, in the course of dynamic filling phases of the depression, a cycle having precise speed and acceleration characteristics adapted to its evolution and defined in advance, and after filling of the depression, before solidification, excess pressure phases at an appropriate predetermined level.

The process according to the invention takes care, in order to impose these characteristics, that random disturbances such as a drop of the metal level in the molds and gas leaks are taken into account.

Another object of the invention is to propose equipment adapted for carrying out this general process and to describe, on the one hand, processes, and on the other hand, apparatus, allowing for a rational and automatic development of the process according to the invention.

In particular, the invention makes it possible to adjust the evolution of the casting cycle according to precise characteristics by using an automatic controlled acting on the discharge pressure of the metal by virtue of a valve controlled by this controller.

The system proposed comprises essentially:

a conventional low-pressure casting machine, an automatic controller, a valve controlled by the controller, a pressure sensor in a furnace containing a crucible, transmitting its information to the controller, a certain number of sensor elements for detecting the presence of metal, the elements being situated along the elevation path of the metal in the mold at the point of change of state, and also transmitting their information to the controller, and a metal temperature sensor located in the crucible and connected to the controller.

According to the process of the invention, the manufacture of a series of parts occurs in two stages as follows:

The first step is a step of development, in which after designing the casting system established in a theoretical fashion, a curve of pressure variation leading to speeds of metal elevation and to excess pressures adapted to result in a part of satisfactory metallurgical quality is plotted. According to one preferred characteristic of the invention, a cycle divided into eight phases is selected.

The first three phases correspond to the filling of the mold. A constant speed of elevation is imposed on the metal which is adapted to the geometry of each part. To do this, a constant speed of variation of discharge pressure is established during these phases.

The first phase corresponds to the step of raising the metal from its level of rest in the crucible towards the mold, and occurs on the interior of a tube opening into the mold.

During this phase, the speed can be very rapid and depends only upon the casting apparatus.

During the second phase, the filling of the inlet cone in the mold occurs.

The third phase corresponds to the entry of the metal in the casting system of the mold, that is to say the portion joining the tube to the mold. This phase is carried out at a variable speed according to the type of parts.

During the fourth phase, the metal fills the depression. This phase can be divided into sub-phases. The optimal speed is thus related to the geometrical shape of the part, particularly the thickness and height. At the end of the fourth phase, the metal should have filled the depression. So as to coordinate during this dynamic portion of the casting the phases of action on the discharge pressure with the various dynamic steps of the metal, four presence detectors (more particularly, interior electrodes extending through the walls of the mold or ultrasonic transmitter-receiver system, which is situated at the upper portion of the feed tube) are situated at the point of charge of geometrical steps and transmit orders to the controller for change of phase.

One sensor, particularly the first met by the metal, makes it possible to establish a connection between the discharge pressure and the external deadhead pressures. To this end, the sensor gives an order to the controller, at the moment of the passage of the metal to its height, to register the level of the discharge pressure. Then, the controller considers only relative pressures in taking, as a zero pressure, the value of the measurement registered during this operation as initiated by the sensor.

Thus, the problem caused by the drop of the metal level in the crucible is resolved. Supplemental sensors can also serve to divide each of the phases into sub-phases.

The three following steps are carried out after filling of the depression.

During phase 5, an excess pressure $\Delta P1$ is established by the ratio of the level of pressure at the end of the filling of the mold. It is carried out during a time $\Delta T1$. The speed and the acceleration of the discharge pressure are selected in a fashion so as to avoid the ram knocking, and so as to be able to utilize molds of fine sand.

During phase 6, an excess pressure $\Delta P2$ is established during a very short time $\Delta T2$.

The sum of $\Delta P1$ and $\Delta P2$ represents the deadhead pressure and must be exerted before the part begins to solidify. $\Delta P1$ and $\Delta P2$, $\Delta T1$ and $\Delta T2$ depend upon the characteristics of the part, and in particular upon the nature of the alloy, its thickness, and its length and height.

Phase 7 corresponds to maintenance of the excess pressure. This phase is interrupted by the controller after information transmitted by a thermocouple indicates the end of solidification at the base of the part.

This thermocouple is situated in the hottest part of the casting system.

Phase 8 is the relaxation phase.

The parameters imposed to the casting, in the course of a test, thus number 8:

(1) the temperature;

(2–4) the speeds of metal elevation in the course of phases 2, 3 and 4. These speeds are proportional to the speeds of variation of pressure in the course of the phases and thus impose the value of these latter;

(5–6) the values of the excess pressure $\Delta P1$ and the time $\Delta T1$; and (7–8) the values of the excess pressure $\Delta P2$ and the time $\Delta T2$.

All of these values can be imposed by means of the discharge pressure.

These parameters enormously influence the metallurgical qualities of the parts by governing the various values of oxide, of blow hole, of non-venue, of inundation, of microporosities, of shrinkage holes, and of microcompressions.

In general, several tests of this type are carried out by iteration and are used, particularly, statistically by varying the parameters of the casting cycle and by further acting on the temperature of the furnace. These tests are continued until obtaining satisfactory metallurgical quality. The controller registers the values of the preceding characteristics effectively obtained in the course of the castings and sends them. Furthermore, it registers and sends the durations of the filling phases of the mold. After each casting, the quality of the parts obtained are examined.

After this series of tests, the eight values of the optimal characteristics of the casting are isolated. The times of phases 5, 6, and 7 are associated with them.

Into the memory of the controller is introduced the correlation existing between the type of the part (or its reference), the eight characteristics of the cycle, and the three durations of the corresponding phases 5, 6, and 7.

The second stage or series production stage can then begin.

The mold having been placed on the low-pressure machine, the only manual operations to be carried out are the posting of the references of the parts and possibly the beginning of the cycle. On these indications alone, the controller carries out the regulation of the casting and of the temperature according to the optimal characteristics which it possesses in memory.

According to a preferred embodiment of the invention, the device utilized in its production phase can be simplified in a fashion so as to possess only a single presence sensor which will be described below. This sensor can be, for example, situated at the outlet of the metal rise tube. The molds are thus without any sensors. In this case, it is wise to utilize this sensor both to interrupt the first phase and to define the level of reference pressure of the casting. This reference takes into account any reduction in metal level.

In this type of casting, and in the series stage, time information, corresponding to the changes of phases 2, 3, and 4, is no longer given by the presence sensors of the mold, but is imposed by the controller itself, according to optimal values of the phases.

Still according to the process of the invention, means are provided so as to be able to form parts having portions of very low thickness. In this case, a depression is created at the end of the interior cavity of the mold and is adapted to form the fine portions of the parts. In the course of casting, the metal imprisons a gas bubble within cavities. According to the invention, the establishment of a vacuum in these cavities is programmed. This action occurs by means of a canal extending through the walls of the mold in the zone considered. This depression is assured by using parameters of the same type as those used in the establishment of excess pressure in the furnace. In this case, the flow of metal is not disturbed by the sharpness of the cavities concerned and it is thus possible to obtain in these zones complete filling with a very satisfactory surface state. This technique thus consists of establishing, in an automatic and regulated fashion, and according to the shapes of the pieces, a vacuum-pressure in zones of low transverse cross-section.

Furthermore, according to the invention, means are provided to avoid liquid metal leaks at the base of the mold. It is, in effect, necessary to maintain the mold in place despite the action of the metal pressure directed from bottom to top.

BRIEF DESCRIPTION OF THE DRAWINGS

Other characteristics and advantages of the invention will become clear from the description which follows with reference to the annexed drawings, which description and drawings are given only by way of non-limiting example.

In the drawings:

FIG. 4 illustrates an ultrasonic pressure sensor utilized, according to the process of the invention, at the upper portion of the riser tube of the metal in the mold;

FIG. 5 illustrates a schematic of a device according to the invention, utilized in molding parts, having a zone of low transverse thickness;

DETAILED DESCRIPTION OF THE INVENTION

Figure 1:
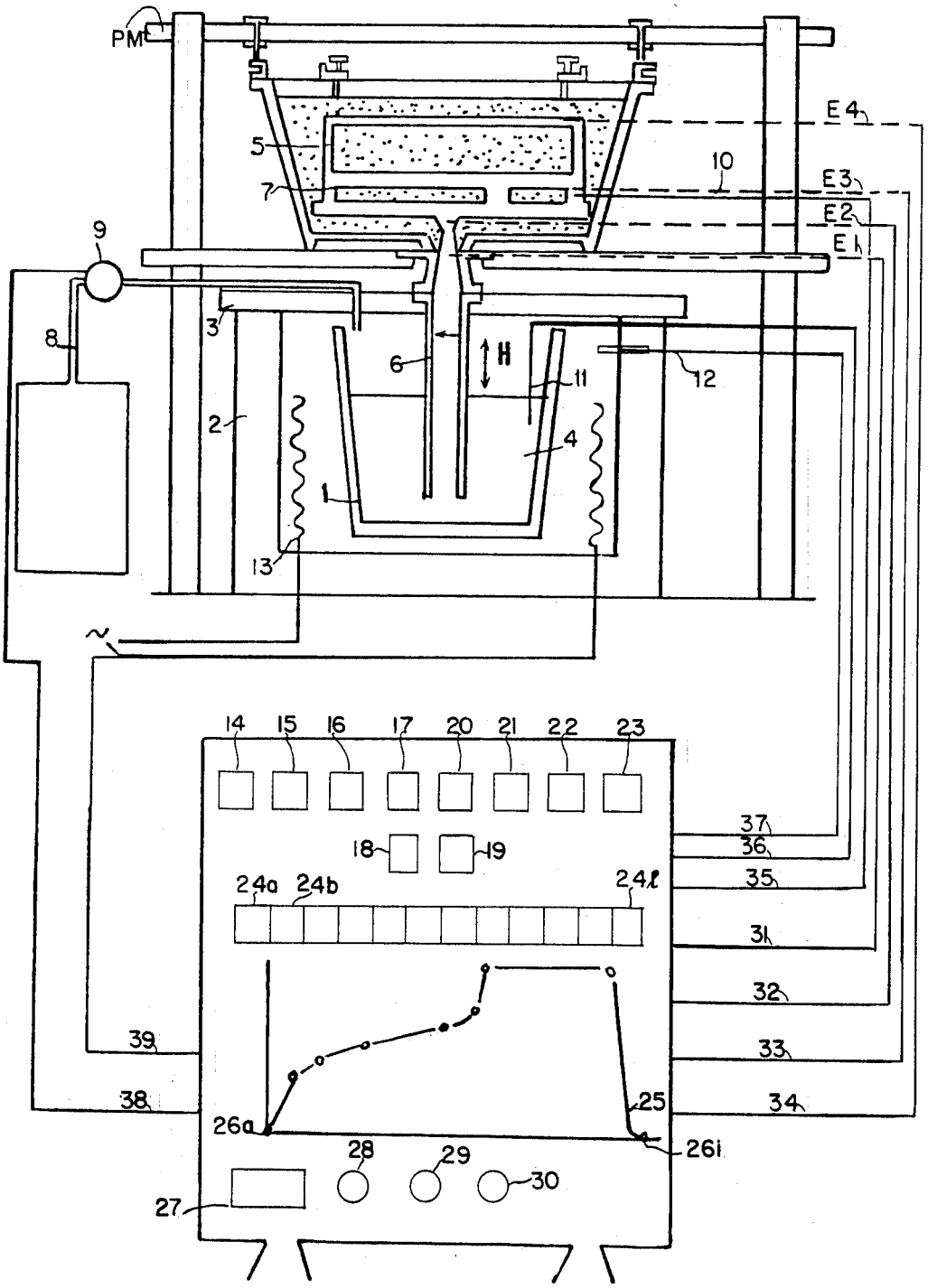
FIG. 1 shows a schematic cross-section of a low-pressure casting machine adapted for carrying out a process according to the invention, as well as a controller which automatically controls the operation.

In FIG. 1, if one refers to the various elements which constitute the casting machine, a crucible 1 is situated on the interior of sealed furnace 2. This furnace is closed by a fixed cover 3. On the interior of the crucible, is located the metal 4. The depression of mold 5 is fed with liquid metal through injection tube 6 and casting system 7. A flow of discharge gas (air or inert gas) is introduced into the mold by means of conduit 8. The mold shown is adapted for the development stage, and is provided with three metal presence sensors E2, E3 and E4. These presence sensors are electrodes placed en masse by the passage of the metal. A fourth sensor E1 is situated in a fixed fashion to the upper portion of pipe 6. To avoid any encrustation of an element immersed due to the succession of casting operations, each presence sensor preferably comprises a system composed of a transmitter, a receiver, a generator and a wave beam analyzer. The preferred form of this system will be given in precise detail below.

An assisted valve 9 controls the arrival of discharge fluid in the mold, a thermocouple 10 is situated at 20 millimeters below the part in the hottest contact of the casting system, and a thermocouple 11 is situated on the interior of the metal crucible. A pressure sensor 12 is placed on the interior of the furnace container. The furnace is heated by a resistance heater 13.

With respect to the controller control board, it has an upper portion with ten code wheels 14–23. The central portion of the board is equipped at its upper portion with twelve meters *24a–24l*, and at its lower portion by a visualization dial 25 on which is shown a broken line cut into nine small lamps *26a–26i*. At the base of the board, on the left, is a coded wheel 27, then a tri-position switch 28, a commutator 29, and a button 30 with luminous visualization.

The four presence sensors E1, E2, E3 and E4, thermocouples 10 and 11, and pressure sensor 12 transmit their information to the controller by means of cables 31–37. The controller, as to it, controls the opening and the closing of the assisted valve 9 by means of cable 38 and the energization of the resistance 13 by means of cable 39.

The performance of the regulation of the casting system by the controller in the course of a development test of a part of a given type will now be described.

Figure 2:
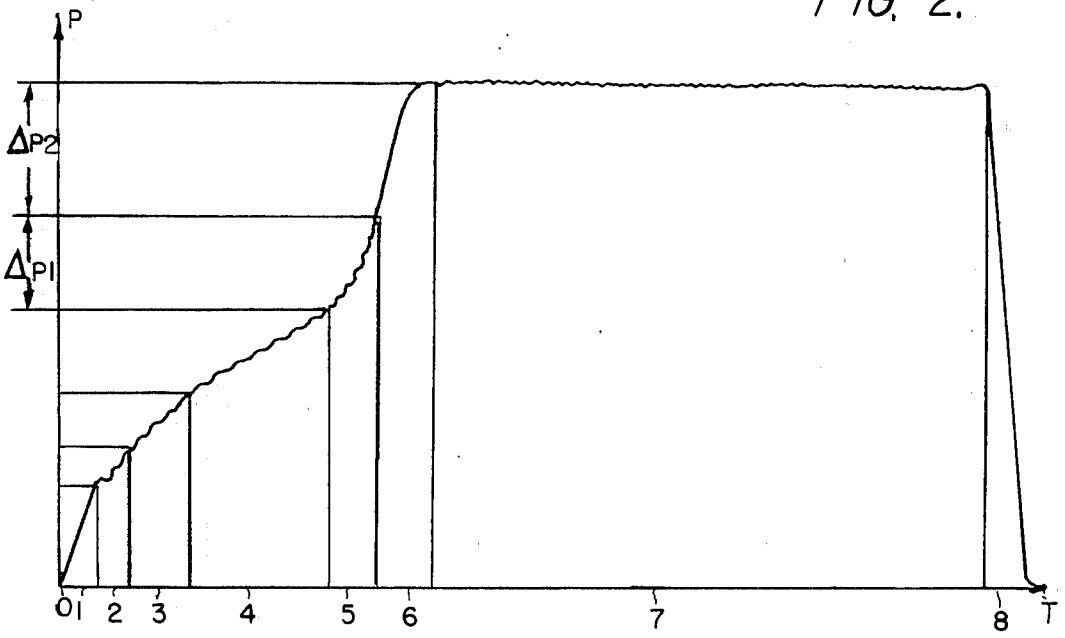
FIG. 2 illustrates a casting cycle deemed ideal according to the invention.

This control consists of imposing to the discharge pressure P a path of variation phases whose curve is shown in FIG. 2.

In FIG. 2, the first four phases numbered 1, 2, 3 and 4 correspond to the dynamic evolution steps of the metal in the mold. Phases 5 and 6 correspond to the establishment of overpressures after filling of the depression by the metal. Phase 7 maintains the excess deadhead pressure in the course of solidification. Phase 8 performs the relaxation of the system; during this phase metal falls back into the crucible.

A test consists of imposing precise speeds of variation of pressure during phases 2, 3 and 4 at levels such that the speed of metal elevation in the molds (which are, as has been seen, proportional to them) are established at selected values V2, V3 and V4. In the course of a test, duration T1 and excess pressure P1 of phase 5 are also imposed, as well as duration T2 and excess pressure P2 of phase 6.

Before any test of this type, coded wheels 14–20 are used to adjust the valves selected for this test of V2, V3, V4, P1, T1, P2, T2. Temperature T of the metal is also set in the course of the casting by virtue of coded wheel 21. All of the fixed valves are displayed on the front face of the coded wheels.

The controller takes into account and memorizes these eight values.

The progress of the casting test will occur in the following fashion.

The mold concerned is first properly positioned.

The apparatus is started by pushing on interrupter 30.

After a stabilization phase of the system which ends by a luminous red visualization of the interrupter, casting begins.

During the first phase, the assisted valve, initially closed, is opened by the controller.

The pressure rises, and the metal initially at rest at its level in the crucible, rises in tube 6 at a speed fixed during the construction of the machine. It reaches metal presence sensor E1. This sensor transmits to the controller information of the passage of the metal at its level. The controller then interrogates pressure sensor 12. This sensor transmits an indication of pressure level in The furnace. The controller memorizes this value and will subsequently consider it as a reference pressure.

From this instant, the controller takes control of all evolution of the system and controls variations in pressure according to a principle which will be explained below, in a fashion so as to establish in the course of the ultimate phases, the characteristics which have been given it and which it has memorized.

Phase 2 then begins.

Metal fills the inlet channel in the mold. In the course of this phase, the controller will act on the assisted valve in a fashion so as to effectively establish the speed of variation of discharge pressure which will dictate the speed of rise of the metal V2. Most oten this speed V2 is less than the speed V1 of rise of the metal in the tube. This phase 2 is interrupted at the moment where the metal passes in front of the presence sensor E2. This information is transmitted to the controller, which then changes phase.

During phase 3, the metal fills the casting system. The controller then imposes, by means of the discharge pressure, a predetermined speed of elevation V3.

During phase 4, metal fills the depression. The controller adapts variations of the discharge pressure in such a fashion so as to raise the speed of the metal to V4, the metal finally encountering electrode E4, which signifies to the controller that metal has completely filled the depression.

The following phases are excess pressure phases.

In the course of phase 5, the controller imposes an increase of pressure ΔP1 during ΔT1.

In the course of phase 6, the controller imposes an increase of pressure ΔP2 during time ΔT2.

During phase 7, the controller stabilizes the excess pressure. The solidification of the metal occurs during the course of this phase, and it is carried out in general from top to bottom. Thermocouple 10 analyzes the level of temperature in the casting system at the base of the depression.

As soon as the temperature reaches the end of the solidification stage, that is to say as soon as the metal is completely solidified in the depression, the information is transmitted to the controller. Phase 7 is terminated, phase 8 begins, and the controller decompresses the container. Liquid metal redescends into the crucible.

In the course of testing, the operator is informed of the elevation of the casting by means of dial 25. In effect, lamps *26a–26i* illuminate successively after each change of phase.

At the end of each step, the controller evaluates and memorizes the characteristics which have been effectively obtained. At the end of the casting, the characteristics of cycles V2, V3, V4, ΔP1, ΔT1, ΔP2, ΔT2, the characteristics of time Δt2, Δt3, Δt4 of phases 2, 3 and 4, and the temperature of the cycle effectively obtained are posted in meters *24a–24k*, respectively.

The operator can use them for purposes of verification.

The principle of operation of the controller is hereinafter described.

It has three principal functions:

an input-output function which connects the controller, on the one hand, to the measurement elements and, on the other hand, to indications given on its display board;

a calculation-comparison-decision function; and a memory function.

Let us consider, for example, the progress of the second phase:

It is initiated by presence sensor E1. From this instant, the controller takes control over the destiny of the casting.

The rhythm of operation of the controller is sequenced by a clock system dividing the scale of time into elementary successive steps.

Figure 3:
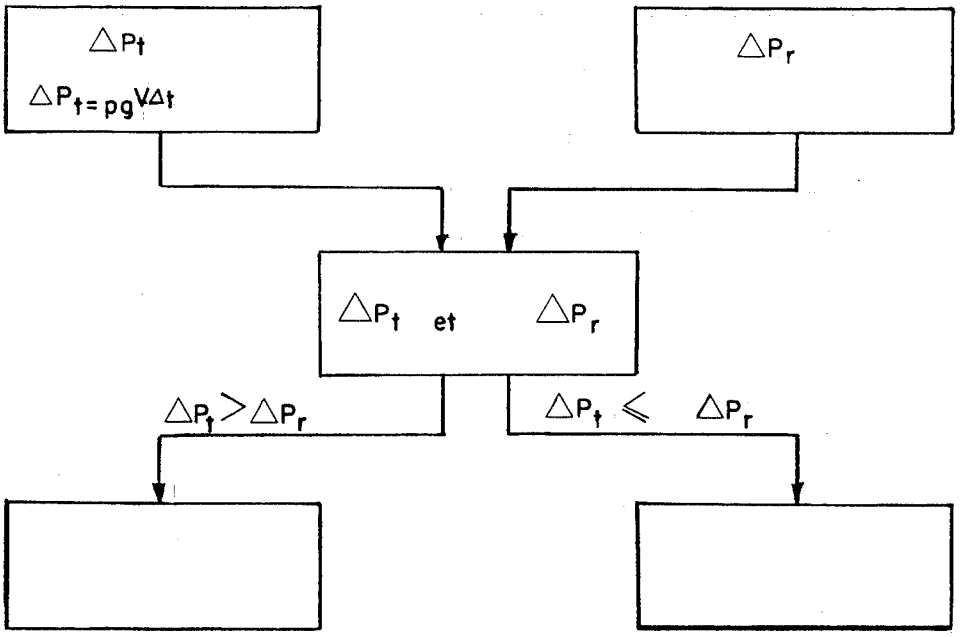
FIG. 3 is a schematic view of the control device of the valve and of the automation device of the cycle.

From the characteristics of the cycle which it has memorized, the controller knows that it must impose a speed of metal elevation V2 in the course of this phase. By virtue of its calculation assembly, it deduces that in the course of each interval of time of this phase, it must increase the pressure by a theoretical amount $\Delta Pt - \rho gV2\Delta t$. Yet, pressure sensor 12, which is plugged into the container, transmits to the controller during the course of each interval of time the value of the real increase in pressure $\Delta Pr$. The controller thus carries out the comparison described in FIG. 3 between $\Delta Pt$ and $\Delta Pr$. If $\Delta Pt$ is greater than $\Delta Pr$, that is to say if in the course of the interval of time the increase of real pressure has been less than the increase of theoretical pressure, the controller opens the assisted valve 9 by means of its input-output assembly. Likewise, if $\Delta Pt$ is less than or equal to $\Delta Pr$, the controller closes the assisted valve 9 and this is repeated successively step by step in the course of the occurrence of the scale before each step of time.

Depending upon whether the controller has been connected by means of commutator 28 in the development or series position, the ends of phases are either communicated from the exterior by presence sensors, or are communicated from the interior by the duration of phases placed in memory and the number of time steps of each phase.

The real curve resulting from the global control of a casting can be visualized with the aid of a plotting table. These curves comprise, as can be seen in FIG. 2, a continuous series of small steps framing the theoretical curve. Each small step corresponds to an interval of time (t) and action of the controller on assisted valve 9.

The four controller functions in the course of these intervals of time are:

the calculation of $\Delta Pt$, the measurement of $\Delta Pr$, the comparison between $\Delta Pt$ and $\Delta Pr$, and the action on the electrovalve.

The system comprises a microprocessor which itself makes it possible to carry out these four functions and to thus arrive at the complete control of the casting.

The apparatus can adapt its pressure control characteristics in a fashion so as to cast parts of from several centimeters to more than 2.50 meters with a satisfactory and constant precision for each of them. To do this, one indicates at the beginning of each casting with the assistance of coded wheel 22 the range within which the pressure will evolve. The controller divides this pressure range into $2^{12}=4{,}096$ steps. Yet, the precision of the control, that is to say the sharpness with which the controller follows the theoretical curve, is expressed by the ratio $\Delta Pt$ from the jump of the discharge pressure $\Delta t$ increase to the duration $\Delta t$ of the corresponding time step.

Also, during the choice of the range, the controller selects the duration of each of the steps in a fashion so as to preserve a constant precision. These durations vary from 50/1000 second for the lowest range to approximately 200/1000 second for the highest range.

Six ranges are made accessible in the apparatus by means of coded wheel 22. For each of these ranges, the increase of each elementary pressure step and the duration of the time step are placed in the memory of the microprocessor during controller construction.

Generally, at the outset of such a test, the parts are observed and their mechanical characteristics evaluated. The tests are performed several times, each taking into account any preceding tests. At the outset of the development series, the optimal characteristics of the cycle, according to which the part must be cast, are statistically established. They are concretely expressed by plotted values at **24*a*–24*k* which have been obtained as a result of the casting of the part which exhibited the best mechanical qualities. The operator then displays, by virtue of coded wheel 27, the reference of the part concerned and places multi-position commutator 28 in a state of registration therewith. The eleven characteristic values of the casting are thus displayed at 27, memorized by the controller in correlation with the reference of the part displayed at 27**.

The succession of the preceding test operations has been described in the case where commutator 29 is in "automatic" position, i.e., phase 7 is interrupted automatically by thermocouple 10. According to another option, when commutator 29 is in "manual" position, duration D of phase 7 is imposed prior to casting amongst the characteristics of the cycle. This is displayed on coded wheel 23.

Still in this case, during registration of the optimal characteristics, the value D found is displayed at 241 and memorized amongst the characteristics to be imposed by the controller for the series phase.

To initiate a series stage a part of a given type, whose development has been previously achieved and whose optimal characteristics are memorized, it suffices to display the reference of the part by virtue of coded wheel 27, to place the multi-position commutator in the series state, and to press operation button 30. The controller then calls the eleven values V2, V3, V4, $\Delta P1$, $\Delta T1$, $\Delta P2$, $\Delta T2$, $\Delta T2$, $\Delta T3$, $\Delta T4$, and $\Delta T$, drawing from the test stage the type of range G and ultimately the duration D. These values are found in the memory, the castings being performed and the parameters obtained displayed at 24.

To achieve a casting of the series stage, it is no longer necessary to utilize molds comprising presence sensors. Only sensor E1 need be maintained. In effect, the time indications transmitted by sensors E2, E3 and E4 during the test phase will be replaced by memorized data $\Delta t2$, $\Delta t3$, and $\Delta t4$.

Outside of these simplifications, the casting in series stage occurs in the same fashion as the castings in the test stage.

FIG. 4 illustrates a preferred presence sensor E1 according to the invention. It is an ultrasonic sensor composed of a generator-decoder assembly 40 outside of the system and a probe 41 situated on the interior of fixed plate 42; it faces and is at the exterior of, connection nozzle 43 shown at the left portion thereof.

The generator-decoder assembly 40 emits a signal in the ultrasonic band which is transmitted to probe 41 by conductor 44 and emitted by the probe. The resulting ultrasonic reflected beam is recovered by probe 41, transmitted to assembly 40 by means of conductor 45, and analyzed by the decoder.

In the case where the casting front of the metal **46*a* is situated at a level below probe 41**, the operation of the apparatus can be illustrated by virtue of the curve in FIG. 4*a*. The probe emits an ultrasonic beam whose action can be schematically illustrated by peak E. This beam is first reflected on the left internal portion 43*a* of the connection nozzle, traverses the internal channel to the connection nozzle while weakening slightly, then reflects itself onto the internal right surface 43*b* of connection nozzle 43.

These successive reflections are characterized with respect to the reflection on the left surface of the nozzle by the peak R1 and on the right surface of the nozzle by the pak R2. Peaks E, R1 and R2 respectively decrease but peaks R1 and R2 are of the same order of magnitude. The two peaks R1 and R2 represent the dephasing of the energy of the beams reflected and received by probe 41 and conducted towards the decoder of assembly 40.

In the case where casting front 46*b* is found at a level above that of probe 41, the operation of the system is shown by the curve 4*b*. The reflections located respectively on the left and right surface of the connection nozzle, are illustrated by peaks R'1 and R'2, the transmission peak being represented by E'. In this case, peak R'2 is quite weakened with respect to peak R'1. These data are, as previously, transmitted to the decoder portion of assembly 40.

During the functioning period, the role of the decoder is to distinguish the positions of the casting front of type 46*a* and of type 46*b*. To do this, the decoder possesses elements capable of distinguishing the resulting peaks of the type R2 and of the type R'2.

The decoder transmits to controller 47, by means of cable 48, information concerning the position of the metal with respect to the position of the probe.

FIG. 5 shows a thin portion of a part during casting. This part is the trailing edge of a turbomachine blade in the course of casting. The metal 49 progresses to the interior of cavity 50 provided on the interior of mold 51. At the end of this cavity is positioned a small channel 52 of 1 mm of height×2 mm of width. This channel opens into a line 53 connected to vacuum source 54 by means of assisted valve 55.

Means ar provided e.g., cable 56, to transmit pressure indications to the controller and to allow it to control the depressurization of the cavity in the course of the advance of metal. These means are of the same type as those described previously and are utilized to control discharge pressure. The controller in this case controls vacuum-pressure so as to aspirate the gas bubble imprisoned by the metal in cavity 40 during its evolution, and to thus allow for good penetration of the metal into all of the points of the depression, while leading to a satisfactory surface state.

An electrode 57 is positioned in certain cases to fulfill the role of a presence detector and to initiate the vacuum-pressure phase directed by the controller. In series phase, 56 and 57 are eliminated and the initiations are carried out by times memorized in the controller.

Figure 6:
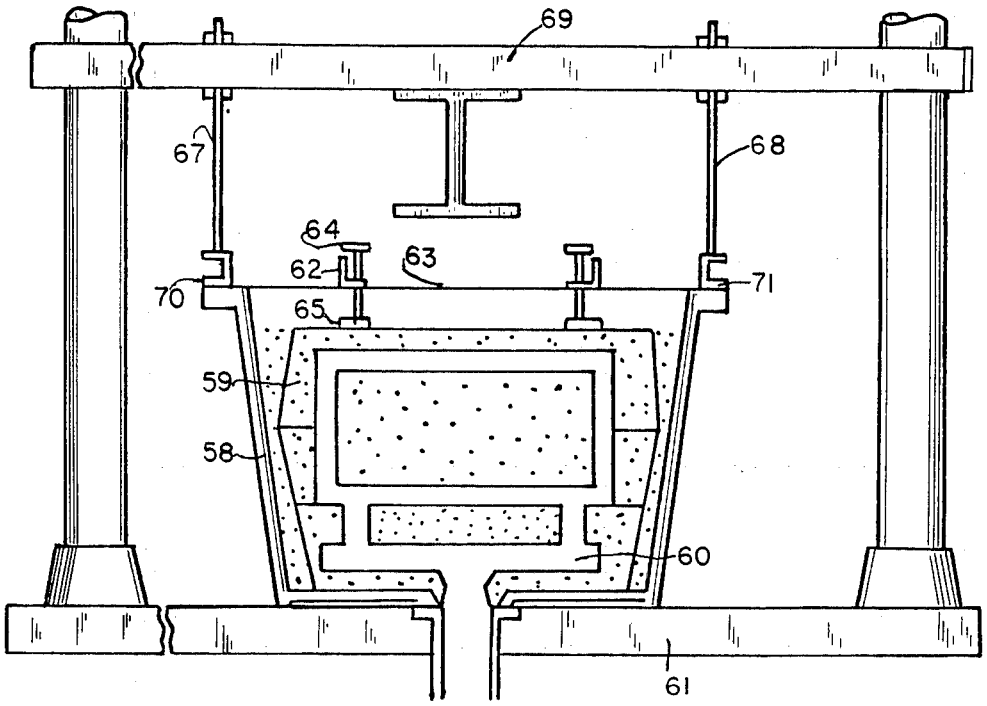
FIG. 6 illustrates a tightening wedge for the molds which is adapted to the development stage.

FIG. 6 shows a mold tightening device utilized during the development phase. This device essentially comprises a metallic case 58 on the interior of which are positioned the cores of sand mold 59. Under the effect of pressure of metal 60 rising in the depression of the mold, the mold supports constraints which tend to elevate it with respect to fixed plate 61. Means are provided to maintain it in place. To this end, guides 62 are attached by pinning across the upper portion 63 of casing 58. Screws 64, integral with guides 62, frontally apply the cores of mold 59 towards the base of the casing by means of wedges 65. The mold and the casing are thus integrated. To apply them against fixed plate 61, bars 67 and 68 transmit a vertical force from top to bottom via mobile plate 69. Different types of wedges 70 and 71 are provided to adapt this system to different dimensions of molds and of housings.

Figure 7:
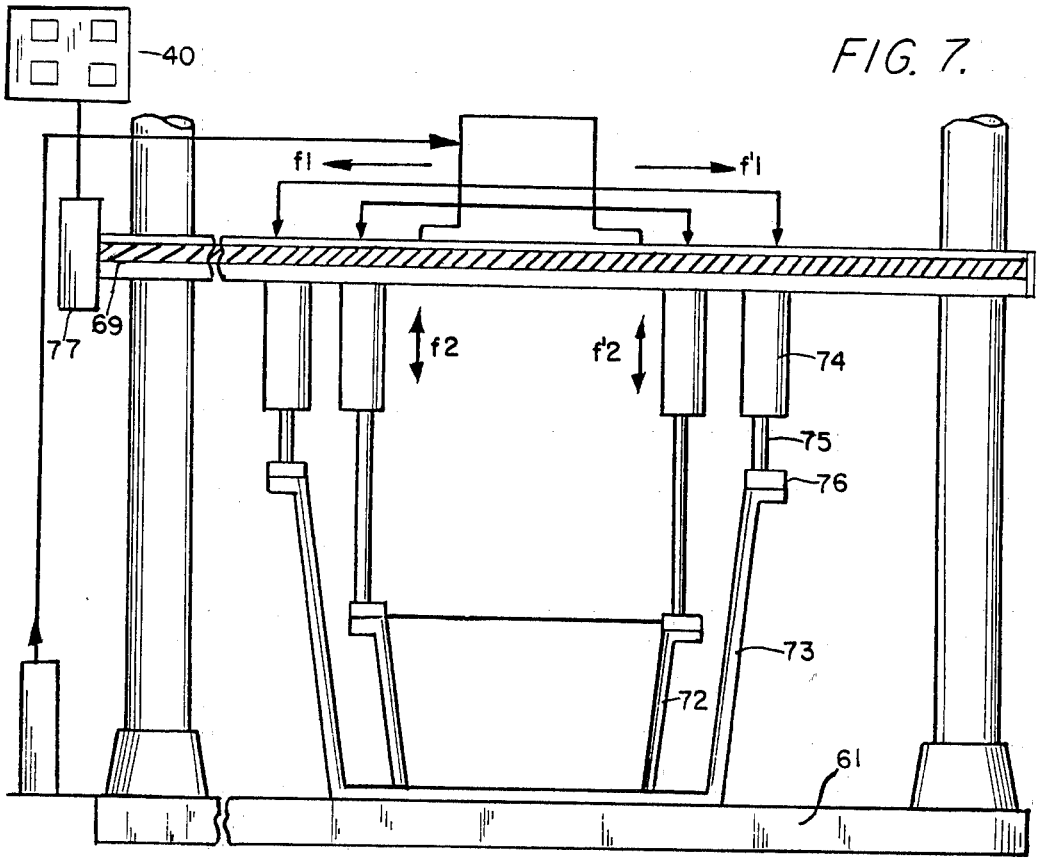
FIG. 7 represents means for solving the problem of wedging in the production stage of various parts.

FIG. 7 illustrates a wedging system utilized during the production stage. It is adapted to successive positioning of molds of different dimensions. To do this, the different molds are maintained in place in casings 72 or 73 by guide-screw-wedge systems of the type shown in FIG. 6. A jack couple 74 is integral with mobile plate 69. Means are provided to symmetrically displace these two jacks on both sides of the axis of the casting machine. The arrows f1 and f'1 symbolize these movements. Furthermore, shafts 75 are vertically movable with respect to each of the jacks and end in a shoulder 76. The arrows f2 and f'2 illustrate these movements. During positioning of the molds, the type of the corresponding part is taken into account by controller 40. This controller possesses in its memory the position of the jacks corresponding to the type of the part. It automatically controls, by means of servomotor 77, the displacement along f1, of the axis of the two jacks so as to bring them to face the upper extent of two metallic casings. The controller then controls the deployment of the two jacks 74. The two shoulders 76 are flattened against casing 73 and against fixed plate 61. Once the casting ends, the controller controls the return of the two jack shafts 75. The mold and the casing containing the freshly casted parts can be evacuated from the system.

One appreciates that the processes and apparatus described above makes it possible to completely master the dynamic, static and thermal conditions of each casting, according to predetermined adjustable characteristics. The conditions imposed in the course of the casting take into account the different types of unexpected variations which can intervene during casting. In this case, the casting process is perfectly dependent of the drop of the level of metal in the crucible, discharge gas leaks, and thermal losses. The casting conditions are entirely reproducible and lead to a production of a series of parts which are exactly identical in quality.

One equally realizes that the process described renders more efficient the successive progress of a series of parts of a given type. It proposes solutions adapted to the development stages and to the series production stages. Each initiation of a series thus does not necessitate anything but very limited human operations.

Furthermore, the materials described are simple, but nevertheless precise and effective in their actions. The ultrasonic sensor system eliminates fouling problems. The process of regulated vacuum procedure allows for the manufacture of very angular parts which, until now, were very difficult to obtain by molding. Finally, the wedging systems proposed considerably simplify the placement of the molds.

It will be noted that the processes described can be adapted to all moldable materials such as magnesium, steel or plastic materials, and that the devices considered can be applied to every pressurized casting apparatus. The origination of the movement of the metal caused by a stream of gas can be completely replaced by a liquid, a turning field or an electromagnetic pump. It suffices, in effect, to know the correlation which exists between the height of the metal in the injection tube and the factor which has caused its movement. This correlation can be, in all cases, established mathematically or experimentally.

The invention having now been expressed and its interest justified by detailed examples, the applicant reserves the exclusivity thereto, during the entire duration of the patent, without limitation other than that of the terms of the claims which follow.

We claim:

1. A process for controlling a casting cycle of a metal casting system based on the geometry of the casting comprising:
   (a) a calibration procedure for determining the optimum pressure in a furnace of the casting system as a function of time to optimize the casting of an article of a particular design; and
   (b) a casting procedure comprising the step of:
      (i) introducing melted metal substance into a furnace;
      (ii) introducing a discharge fluid under pressure into said furnace to pressurize the metal substance;
      (iii) sensing the presence of the metal substance at a location relating to the entry of the metal substance into a mold of the system to determine an initial time;
      (iv) continuously sensing the real value of the pressure of the discharge fluid and comparing it to the optimum pressure of the discharge fluid as a function of time based upon said initial time;
      (v) continuously adjusting the pressure in said furnace to conform to said optimum pressure.

2. A process in accordance with claim 1, wherein said casting procedure further comprises:
   (vi) conducting said pressurized metal substance at an initial velocity through a conduit having one end positioned within said furnace and another end opening into said mold.

3. A process in accordance with claim 2, further comprising:
   (vii) conducting said pressurized metal substance through said mold at a velocity which is insufficient to cause turbulence and yet sufficient to prevent leakage of the metal.

4. A process in accordance with claim 3, further comprising applying a vacuum within said mold.

5. A process in accordance with claim 4, comprising applying said vacuum within reduced cross-sectional areas of said mold.

6. A process in accordance with claim 3, further comprising:
   (c) a compensation procedure involving:
      (i) securing said mold within a housing; and
      (ii) compensating for pressure exerted by said metal within said mold by applying force against said housing in a direction opposite to the direction in which pressure is exerted by said metal.

7. A process in accordance with claim 6, wherein a wedging system including wedging elements is used for applying force against said housing, and said compensating procedure further involves:
   (iii) determining the optimum position of said wedging elements for each article of particular design;
   (iv) inputting said optimum position into a data processor; and
   (v) programming said data processor to adjust said wedging elements to said optimum position.

8. A process for controlling a casting cycle in accordance with claim 3 wherein said calibration procedure comprises:
   (i) sensing the presence of the metal substance in said mold at least once as the metal is conducted through the mold; and
   (ii) recording parameters of casting including the time at which the presence of metal substance in the mold is sensed, as a function of said initial time, and the pressure in the furnace of the casting system at each time the presence of metal is sensed.

9. A process in accordance with claim 8, wherein said calibration procedure is performed a plurality of times for each article of particular design until a casting having desired metallurgical characteristics is obtained prior to performing said casting procedure.

10. A process in accordance with claim 9, wherein said calibration procedure comprises:
   (i) inputting said optimum parameters to a data processor; and
   (ii) programming said data processor to control the casting procedure using said optimum pressure.

11. A process in accordance with claim 10, comprising adjusting the pressure automatically by said data processor.

* * * * *